US006752705B1

(12) United States Patent
Lin

(10) Patent No.: US 6,752,705 B1
(45) Date of Patent: Jun. 22, 2004

(54) PNEUMATIC TOOL WITH SAFETY EFFECT

(75) Inventor: Freddy Lin, Taichung (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 0 days.

(21) Appl. No.: 10/408,312

(22) Filed: Apr. 8, 2003

(51) Int. Cl.[7] ..... B24B 23/00; B24B 55/00
(52) U.S. Cl. ..... 451/295; 451/357
(58) Field of Search ..... 451/295, 359, 451/357, 344, 356, 354, 451, 456

(56) References Cited

U.S. PATENT DOCUMENTS 3,775,911 A * 12/1973 Flagge ..... 451/359
3,934,657 A * 1/1976 Danielson ..... 173/169
4,016,684 A * 4/1977 Urda ..... 451/344
4,103,460 A * 8/1978 Law ..... 451/344
4,660,329 A * 4/1987 Hutchins ..... 451/357
4,986,036 A * 1/1991 Hutchins ..... 451/344
6,007,412 A * 12/1999 Hutchins ..... 451/295
6,343,982 B1 * 2/2002 Sun ..... 451/357

* cited by examiner

*Primary Examiner*—Robert A. Rose
(74) *Attorney, Agent, or Firm*—Troxell Law Office PLLC

(57) ABSTRACT

A pneumatic tool with safety effect, including: a main body formed with an internal flow way for a fluid to flow into the main body to drive a cylinder therein; a press switch disposed in the main body for blocking the flow way in normal state; a trigger disposed on the main body for pressing the press switch; a slide member slidably disposed on the main body; and a linking member disposed on the slide member. In normal state, the slide member is such positioned that a position difference exists between the linking member and the press switch. When activating the pneumatic tool, a user pushes the slide member to move the linking member to a position above the press switch. By means of pressing the trigger, the linking member is driven to press the press switch.

18 Claims, 9 Drawing Sheets

PNEUMATIC TOOL WITH SAFETY EFFECT

BACKGROUND OF THE INVENTION

The present invention is related to a pneumatic tool, and more particularly to a pneumatic tool with safety effect. In case a user mis-touches the switch, the pneumatic tool protects the user from getting hurt.

The switch of a conventional small-size pneumatic grinder is controlled by a trigger. The trigger is disposed on top face of the main body of the grinder, while the grinding disc is arranged on bottom face of the main body. The grinder has small volume and can be held by a hand. In operation, the main body of the grinder is held by a user's hand and the trigger is pressed down by the palm to switch on the switch and turn on the grinder.

When replacing the grinding disc, the user also holds the main body to disassemble the grinding disc. In such procedure, it is quite easy to touch the trigger. In the case that the user does not extract the high pressure air conduit prior to replacement of the grinding disc, when the trigger is touched, the switch will be switched on to rotate the grinding disc. Under such circumstance, the operator may get hurt. Even if the grinding disc is not being replaced, the operator is still easy to mis-touch the trigger and get hurt.

Moreover, the small-size pneumatic grinder is not equipped with any dust collector so that in grinding, the powder tends to scatter and fly around to contaminate the environment.

SUMMARY OF THE INVENTION

It is therefore a primary object of the present invention to provide a pneumatic tool with safety effect. A user is prevented from mis-touching the trigger so that the pneumatic tool will not be unexpectedly activated to hurt the user.

It is a further object of the present invention to provide the above pneumatic tool which itself can effectively remove the powder generated in grinding operation.

The present invention can be best understood through the following description and accompanying drawings wherein:

DETAILED DESCRIPTION OF THE PREFERRED EMBODIMENTS

Figure 1:
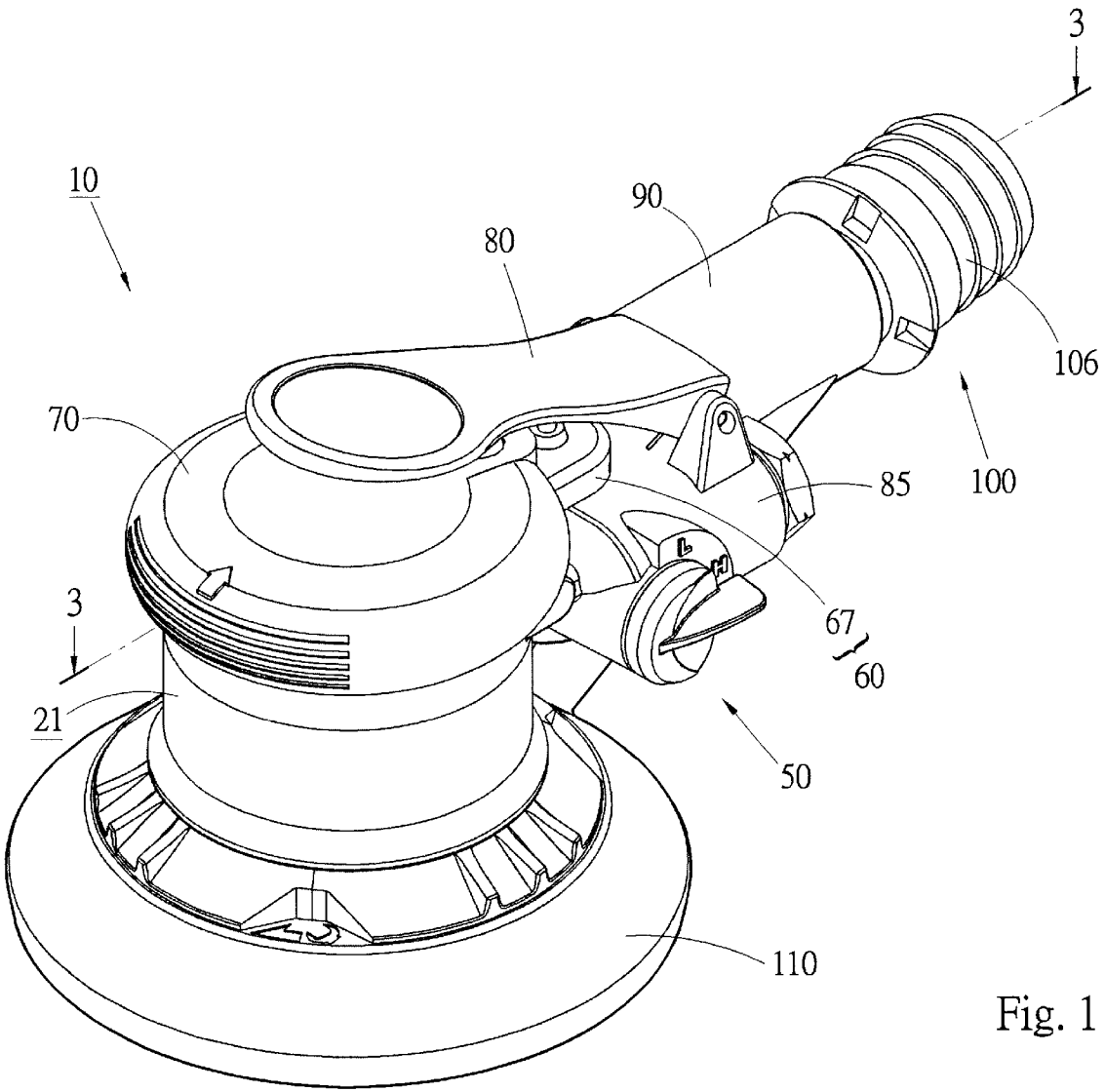
FIG. 1 is a perspective assembled view of a preferred embodiment of the present invention.
Figure 2:
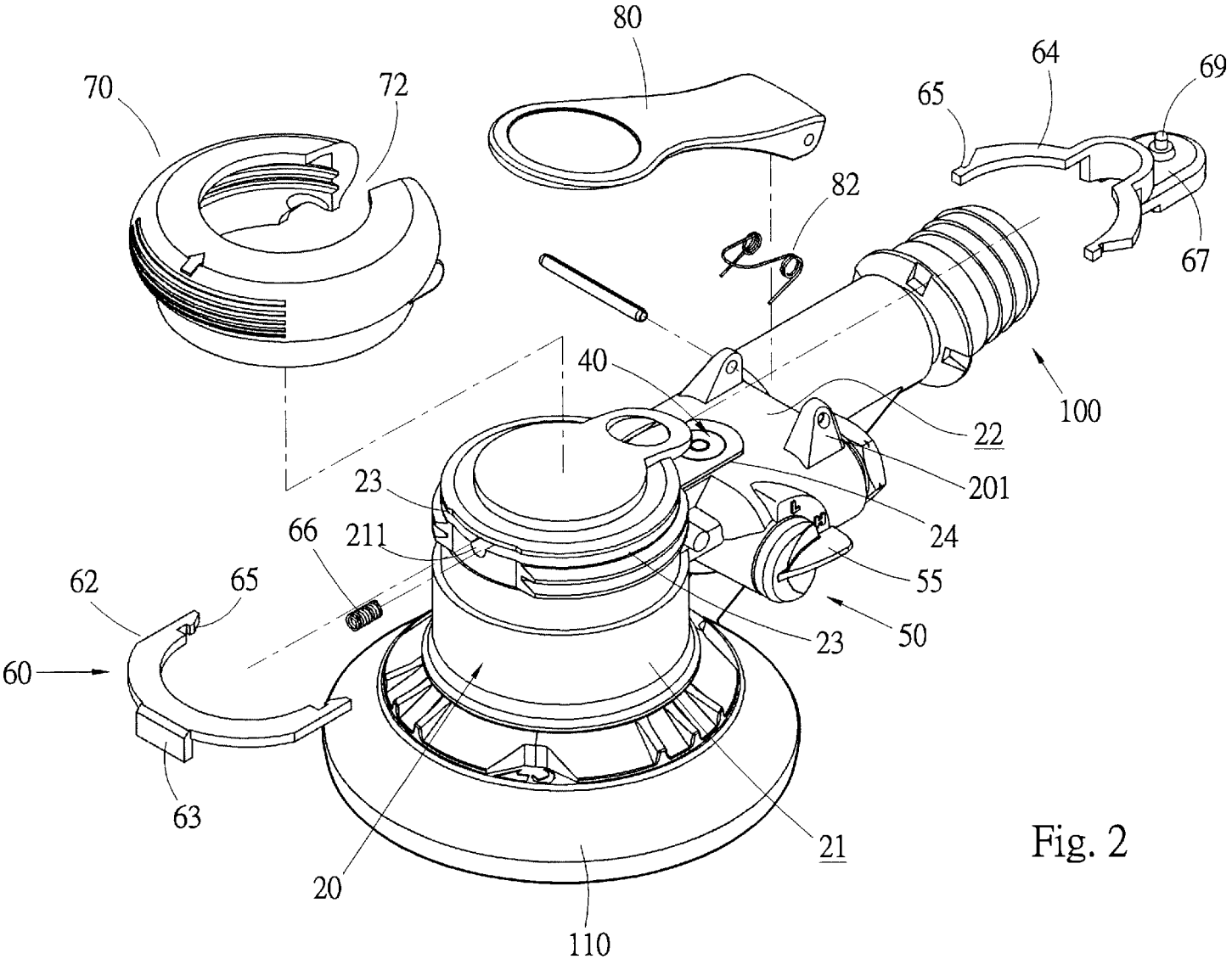
FIG. 2 is a perspective exploded view according to FIG. 1.

Please refer to FIGS. 1 and 2. According to a preferred embodiment, the pneumatic tool of the present invention is a pneumatic grinder 10. The pneumatic grinder 10 includes a main body 20, a press switch 40, an adjustment switch 50, a slide member 60, a linking member, a sheath 70, a trigger 80 and a tube body 90.

Figure 3:
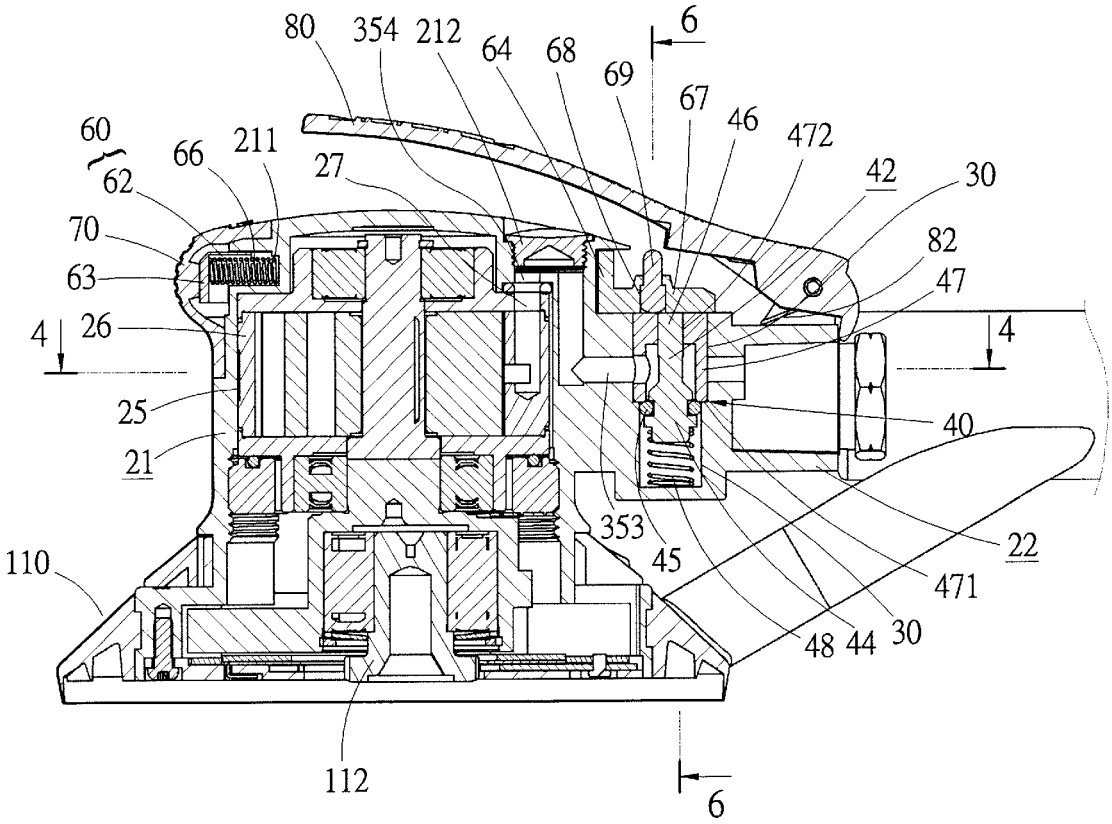
FIG. 3 is a sectional view taken along line 3—3 of FIG. 1.
Figure 4:
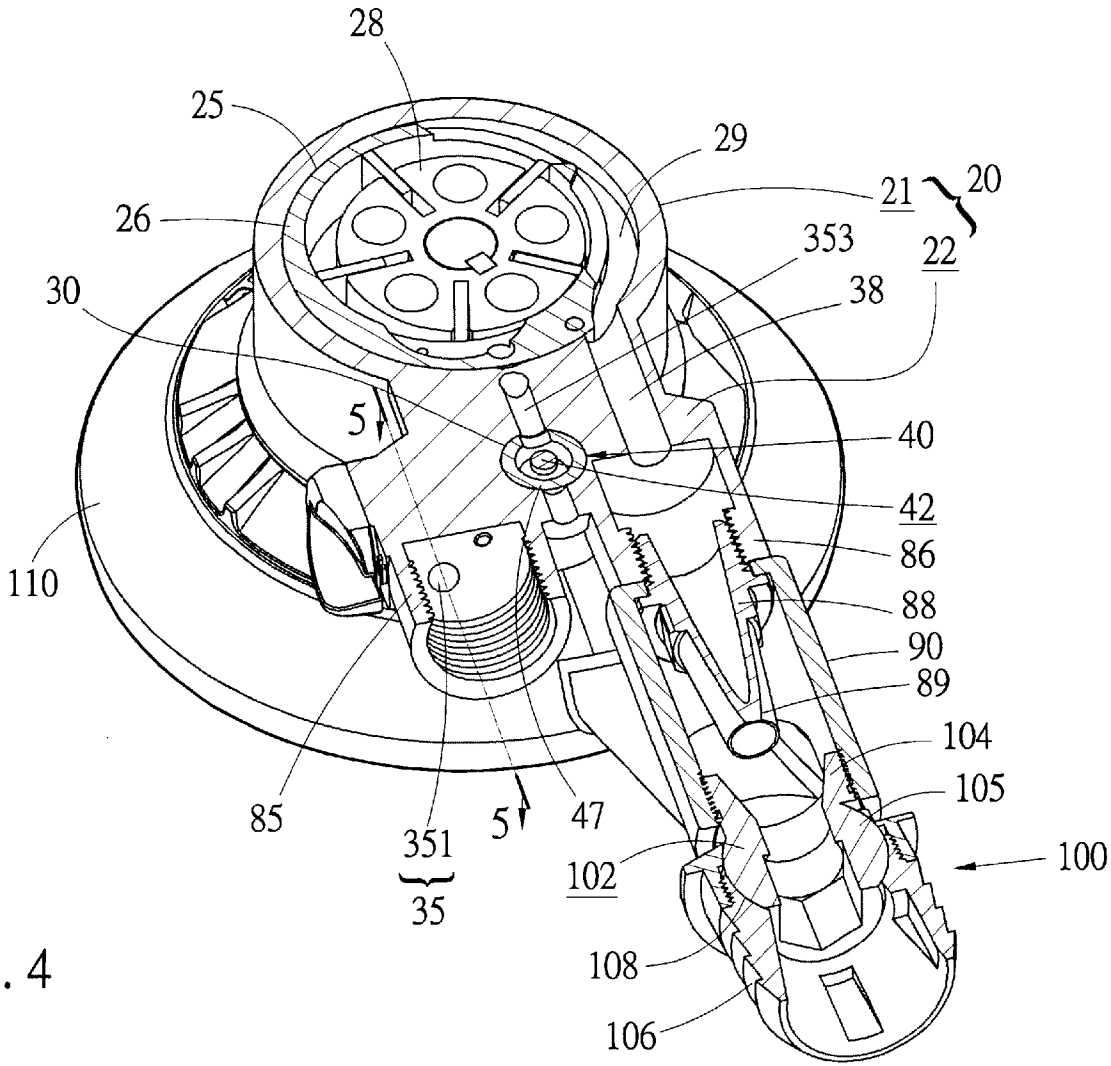
FIG. 4 is a rear perspective sectional view taken along line 4—4 of FIG. 3.
Figure 5:
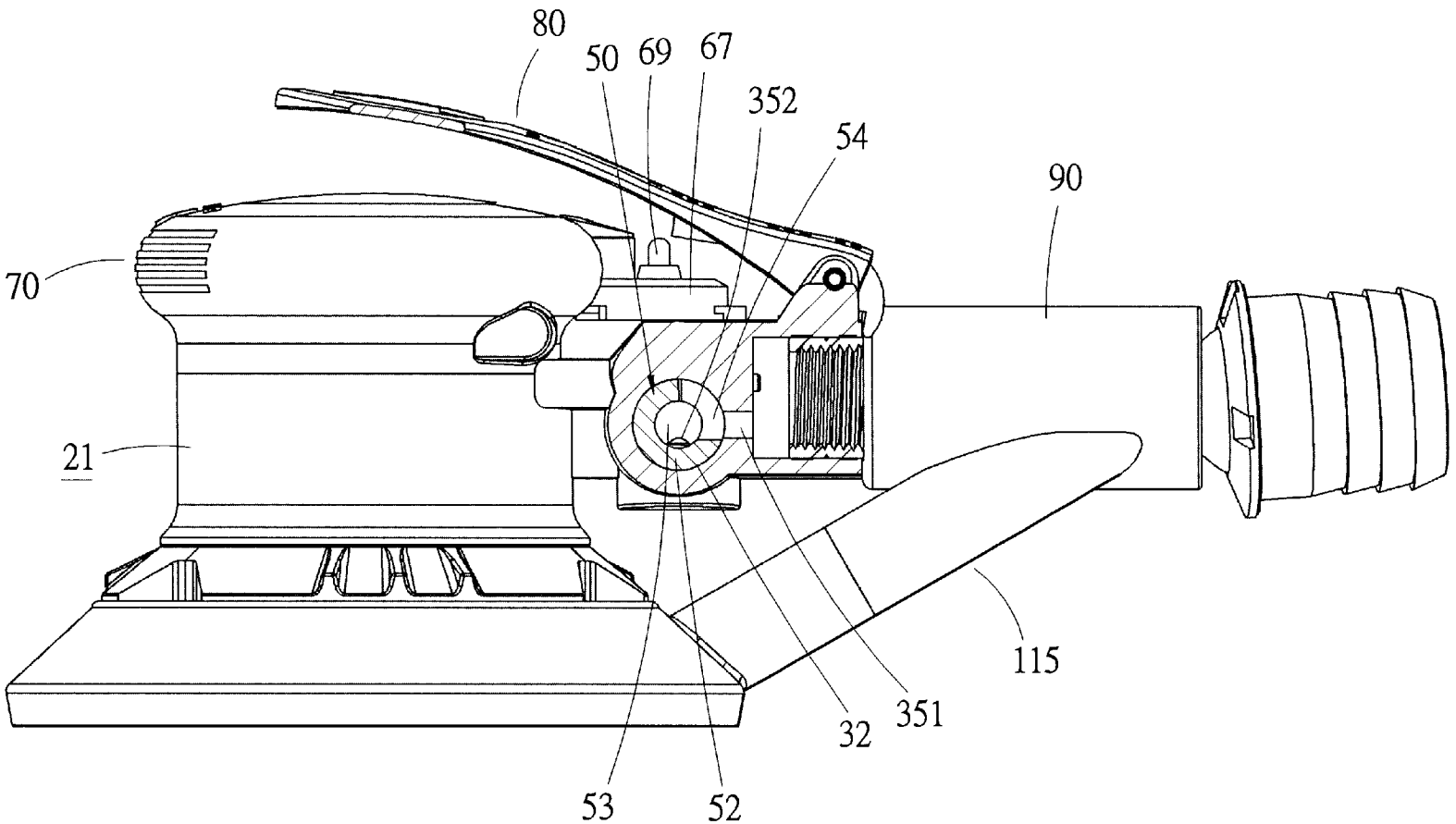
FIG. 5 is a sectional view taken along line 5—5 of FIG. 4.
Figure 6:
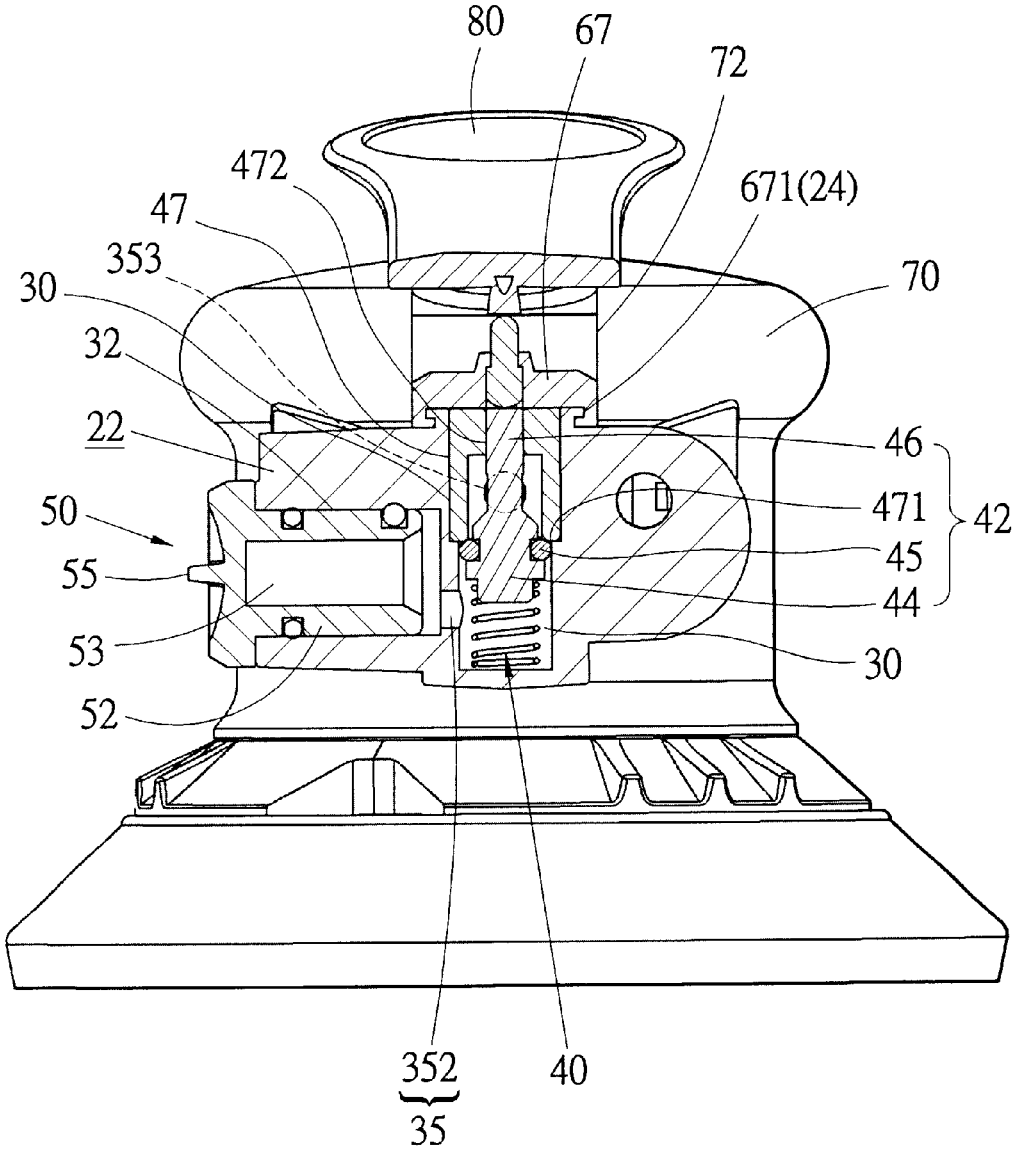
FIG. 6 is a sectional view taken along line 6—6 of FIG. 3.

The main body 20 has a main section 21 and an extension section 22 connected with rear side of the main section 21. A guide channel 23 is formed on the circumference of the main section 21. As shown in FIGS. 3 and 4, a cylinder room 25 is formed in the main section 21. A cylinder 26 and a rotor 28 positioned in the cylinder 26 are mounted in the cylinder room 25. In addition, as shown in FIGS. 3 and 6, the top face of the extension section 22 is inward recessed to form a chamber 30 in the main body. As shown in FIGS. 5 and 6, one side of the extension section is inward recessed to form a dent 32.

Referring to FIG. 4, the extension section 22 is formed with a flow way 35 and an exhaustion port 38, the front ends of which both communicate with the cylinder room 25, while the rear ends of which are positioned at rear end of the extension section 22 to communicate with outer side. Referring to FIG. 5, in this embodiment, the flow way 35 includes a first pore section 351 passing from the extension section to the dent 32, a second pore section 352 communicating with the dent and the chamber 30 as shown in FIG. 6, a third pore section 353 extending from the chamber 30 to the main section 21 and extending upward and communicating with a fourth pore section 354 via a sealing cap 212 screwed in top face of the main section 21. The fourth pore section 354 communicates with the intake 27 of the cylinder 26. Accordingly, the high pressure air can go through the flow way 35 into the cylinder. The circumference of the cylinder is formed with several outlets 29 as shown in FIG. 4. The air going into the cylinder can be exhausted through the outlets 29 into the cylinder room 25 and then exhausted through the exhaustion port 38.

The press switch 40 as shown in FIGS. 3 and 6 includes a valve member 42 having a valve section 44 and a rod section 46 connected with an upper side of the valve section. The valve member is up and down movably fitted in the chamber 30. The press switch 40 further includes a barrel section 47 tightly fitted in the chamber. The bottom end of the barrel section 47 is formed with a shoulder face 471 positioned in the chamber between the second pore section 352 and third pore section 353 of the flow way. The valve section 44 is positioned under the shoulder face 471. The press switch 40 further includes a resilient member 48 disposed between the bottom face of the chamber 30 and the valve section 44. In normal state, the resilient member resiliently keeps pushing the valve member 42 upward to an upper dead end. A leakproof ring 45 is disposed on the circumference of the valve section to tightly abut against the shoulder section 471 for blocking the flow way 35. When the press switch 40 is positioned in a closed position, the flow way is closed. The rod section 46 is fitted through a through hole 472 formed on top end of the barrel section 47.

Figure 7:
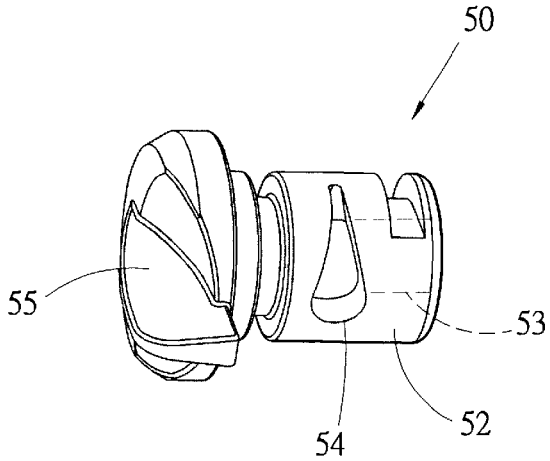
FIG. 7 is a perspective view of the adjustment switch of the present invention.

Referring to FIG. 7, the adjustment switch 50 has a cylindrical valve body 52 and a shift switch 55 connected with one end of the valve body. A free end of the valve body 52 is formed with a shaft hole 53. The circumference of the valve body is formed with a circumferential slot 54 communicating with the shaft hole 53. The width of the slot 54 is tapered from one end to the other. The valve body 52 of the adjustment switch 50 is airtight mounted in the dent 30 as shown in FIGS. 5 and 6. The shaft hole 53 is aligned with the second pore section 352, while the slot 54 is aligned with the first pore section 351 of the flow way 35 as shown in FIG. 5. The shift switch 55 is positioned on outer side for an operator to turn the valve body 52.

Referring to FIGS. 2 and 3, the slide member 60 is back and forth slidably mounted on the guide channel 23 of the main section 21. In this embodiment, the slide member has a U-shaped front half 62 and a U-shaped rear half 64 each having two arms formed with hook sections 65. The hook sections 65 are hooked with each other to assemble the two halves 62, 64 together, the two halves are inlaid in the guide channel 23. A resilient member 66 is mounted in-a recess 211 of front end face of the main section 21. One end of the resilient member abuts against the main section, while the other end thereof abuts against an abutted section 63 disposed at front end of the front half 62. When not suffering external pressing force, the slide member 60 is kept at a front dead end of the sliding movement of the slide member 60 as shown in FIG. 3. At this time, the inner edge of the rear half 64 of the slide member abuts against the main body and is located in a non-operation position. A platform 67 rearward extends from rear end of the rear half 64. The bottom face of the platform 67 is formed with an insertion channel 671 as shown in FIG. 6, in which a guide rail 24 disposed on top face of the extension section 22 is inserted. By means of the guiding of the guide rail 24, the slide member can be moved back and forth. A through hole 68 passes through the platform 67 from top face to bottom face thereof.

The linking member which is a touch rod 69 is up and down slidably fitted in the through hole 68 of the platform 67. The touch rod 69 and the through hole 68 both have large diameter sections and small diameter sections, whereby when the touch rod is slid upward, the large diameter section thereof abuts against the small diameter section of the through hole as an upper dead end to prevent the touch rod from being upward extracted out of the through hole. In normal state, the top end of the touch rod protrudes from the platform 67 by a certain height, while the bottom end thereof falls onto the bottom face of the extension section 22. When the slide member 60 is positioned in the non-operation position, a position difference exists between the touch rod 69 and the valve member 42 of the press switch as shown in FIG. 3.

The rubber-made soft protective sheath 70 is fitted on top end of the main section 21 of the main body to enclose the slide member 60 and provides a dustproof effect as well as enhance comfortableness when holding the top end of the main body 20. The rear end of the protective sheath 70 is formed with a split 72 through which the platform 67 protrudes from the protective sheath 70 and is exposed to outer side.

A rear end of the trigger 80 is pivotally connected with a pair of lugs 201 of rear end of the main body 20, whereby the trigger 80 can be swung within a certain angular range. A torque spring 82 is disposed between the main body and the trigger. Two ends of the torque spring 82 respective abut against the main body and the trigger to keep the trigger pivoted upward.

In addition, the rear end of the extension section 22 of the main body 20 is formed with two fitting mouths 85, 86 respectively corresponding to the flow way 35 and the exhaustion port 38 as shown in FIG. 4. The fitting mouth 85 corresponding to the flow way is for connecting with an air conduit, while the fitting mouth 86 corresponding to the exhaustion port is fixed with a nozzle 88.

Figure 8:
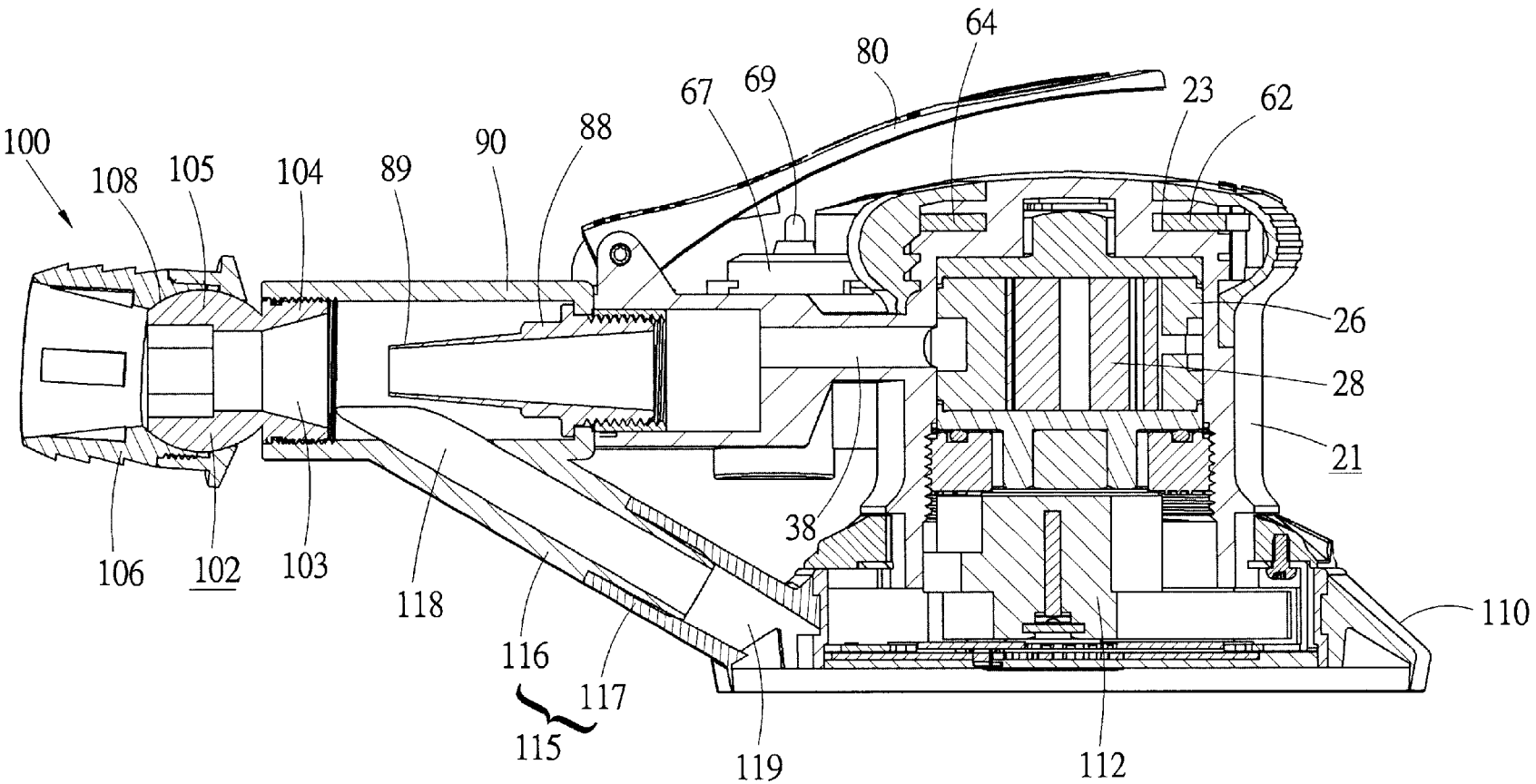
FIG. 8 is a longitudinal sectional view of the tube body of the present invention.

Referring to FIGS. 4 and 8, one end of the tube body 90 is fixed at the rear end of the extension section with the nozzle 88 positioned in the tube body 90. A rear end of the tube body 90 rearward extends by a certain length longer than the opening 89 of the nozzle 88.

The present invention further includes a ball valve connector 100 having a ball valve body 102 and a connector 106. The ball valve body 102 is formed with an internal axial through hole 103. One end of the ball valve body 102 is a connecting end 104 connected with the rear end of the tube body 90. The other end thereof is ball valve section 105 protruding out of the tube body. A front end of the connector 106 is formed with a spherical socket 108 in which the ball valve section 104 is fitted. Accordingly, the connector can be universally rotated on the ball valve section for connecting with an exhaustion conduit.

In addition, a cover 110 is disposed at bottom end of the main body 20 as shown in FIGS. 1 and 8. A grinding disc (not shown) is detachably connected with an eccentric rotary shaft 112 of the grinder. The rotary shaft is driven by the rotor 28 of the cylinder 26. The grinding disc is covered by the cover 110.

A communicating tube 115 is connected with the cover 110 and the tube body 90. In fact, the communicating tube is composed of a tube body 116 extending from bottom side of the tube body 90 and a tube body 117 extending from outer wall of the cover. The tube bodies 116, 117 are inserted and connected with each other to form the communicating tube 115, whereby the interior of the cover communicates with the tube body 90. The adjoining section between the communicating tube 115 and the tube body 90 is formed with a portal 118 right positioned in the position of the opening 89 of the nozzle. The adjoining section between the communicating tube 115 and the cover 110 is formed with a second portal 119.

The use of the present invention is described as follows:

In normal state, as shown in FIG. 3, the trigger 80 is lifted and the slide member 60 is pushed by the resilient member 66 and positioned in the non-operation position. At this time, a position difference exists between the touch rod 69 and the valve member 42 of the press switch 40. Under such circumstance, the press switch 40 is positioned in the closed position and the flow way 35 is blocked so that the grinder does not operate.

Figure 9:
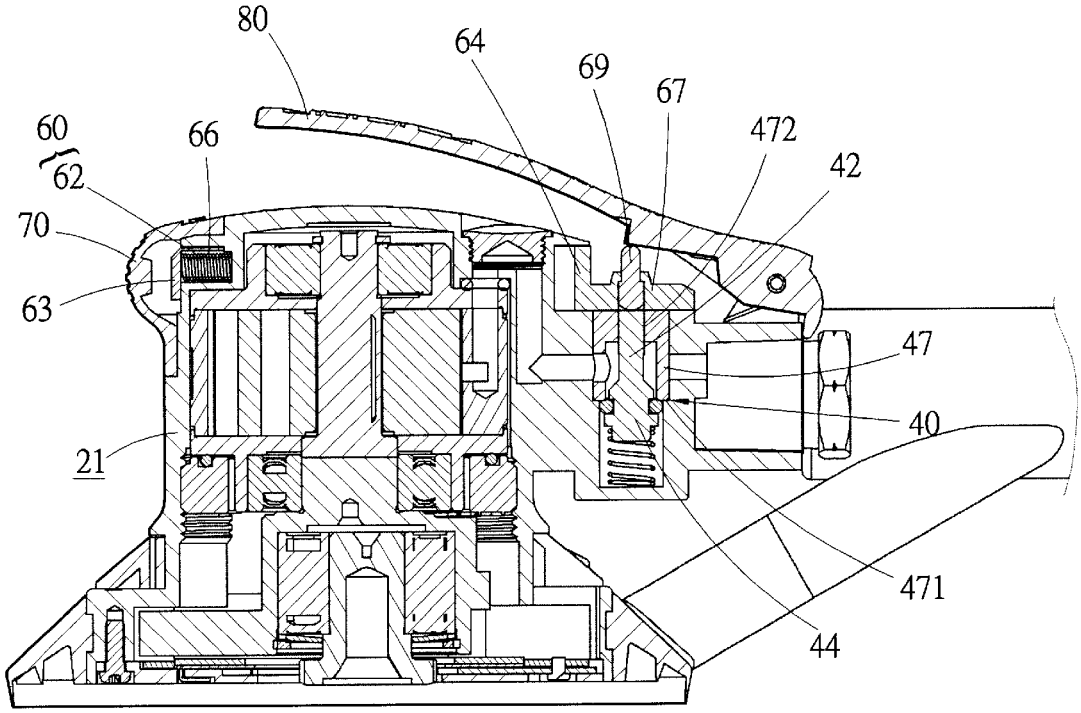
FIG. 9 is a view according to FIG. 3, showing that the slide member is rearward moved.

When activating the grinder, a user holds the top face of the main body 20 with one hand and rearward presses the slide member 60 as shown in FIG. 9. At this time, the slide member is moved rearward to an operation position and the touch rod 69 is moved to a position right above the press switch and aligned with the valve member 42.

Figure 10:
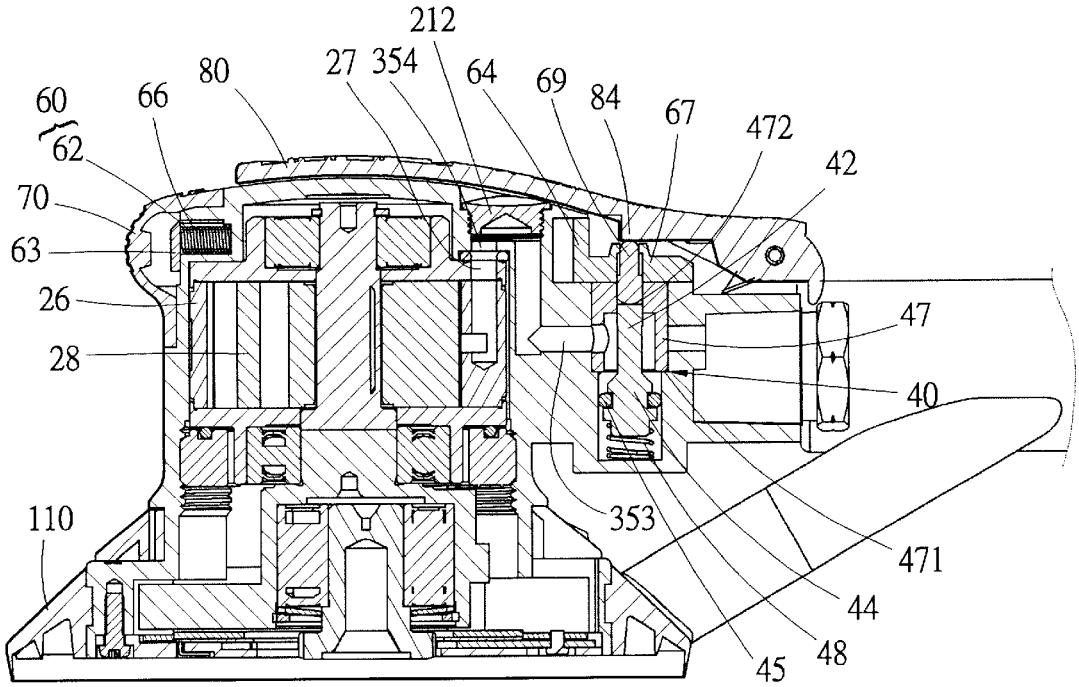
FIG. 10 is a view according to FIG. 9, showing that the press switch is pressed.

Then the trigger 80 is pressed down by the hand as shown in FIG. 10. A press section 84 of bottom face of the trigger downward pushes the touch rod 69 and makes the touch rod extend into the through hole 472 of the barrel section 47 to downward push the valve member 42 to an opened position. At this time, the valve section 44 leaves the shoulder section 471 and airtight state between the leakproof ring 45 and the shoulder face is eliminated. Accordingly, the flow way 35 is freed. The high pressure air flows into the flow way 35 and goes through the first pore section 351 thereof into the dent 32 and flows into slot 54 and shaft hole 53 of the adjustment switch 50. The air further flows through the second pore section 352 into the chamber 30 and then flows to the third pore section 353 and the fourth pore section 354. The high pressure air then flows from the intake 27 of the cylinder 26 into the cylinder to drive the rotor 28 to rotate. Accordingly, the grinding disc is driven to grind or buffer a work piece.

After driving the rotor, the high pressure air flows from the outlet 29 of the cylinder into the cylinder room 25 and is then exhausted from the exhaustion port 38 as shown in FIG. 8. The waste gas is ejected from the nozzle 88 to flow into the tube body 90 and then flow into the exhaustion conduit connected with the ball valve connector 100 and discharge.

After the trigger 80 and the slide member 60 are released from the pressing force, the trigger is restored to its home position by the torque spring 82. The valve member 42 of the press switch 40 is pushed back to the closed position by the resilient member 48 to block the flow way. The slide member 60 is resiliently restored to the state of FIG. 3 by the resilient member 66.

In operation, in the case that the slide member 60 is not rearward pressed, a position difference exists between the touch rod 69 and the valve member 42 of the press switch 40. Under such circumstance, even if the touch rod is pressed, the switch 40 cannot be switched. Accordingly, an insurance effect is provided.

When the flow way 35 is freed, the adjustment switch 50 can be turned to adjust the angular position of the valve body 52 and align the wider end or narrower end of the slot 54 with the first pore section 351 of the flow way. Accordingly, the flow amount of the high pressure air flowing into the cylinder 26 can be regulated so as to control the rotational speed of the grinder.

The present invention has an advantage as follows:

The pneumatic tool of the present invention provides a safety effect. In operation, in the case that the slide member is not rearward pressed, even if the trigger is pressed, the press switch cannot be switched. Accordingly, in the case that the power source is not disconnected, when replacing the grinding disc or in an abnormal operation state, even if a user incautiously touches the trigger, the grinder will not be activated so that the user is protected from getting hurt.

Figure 11:
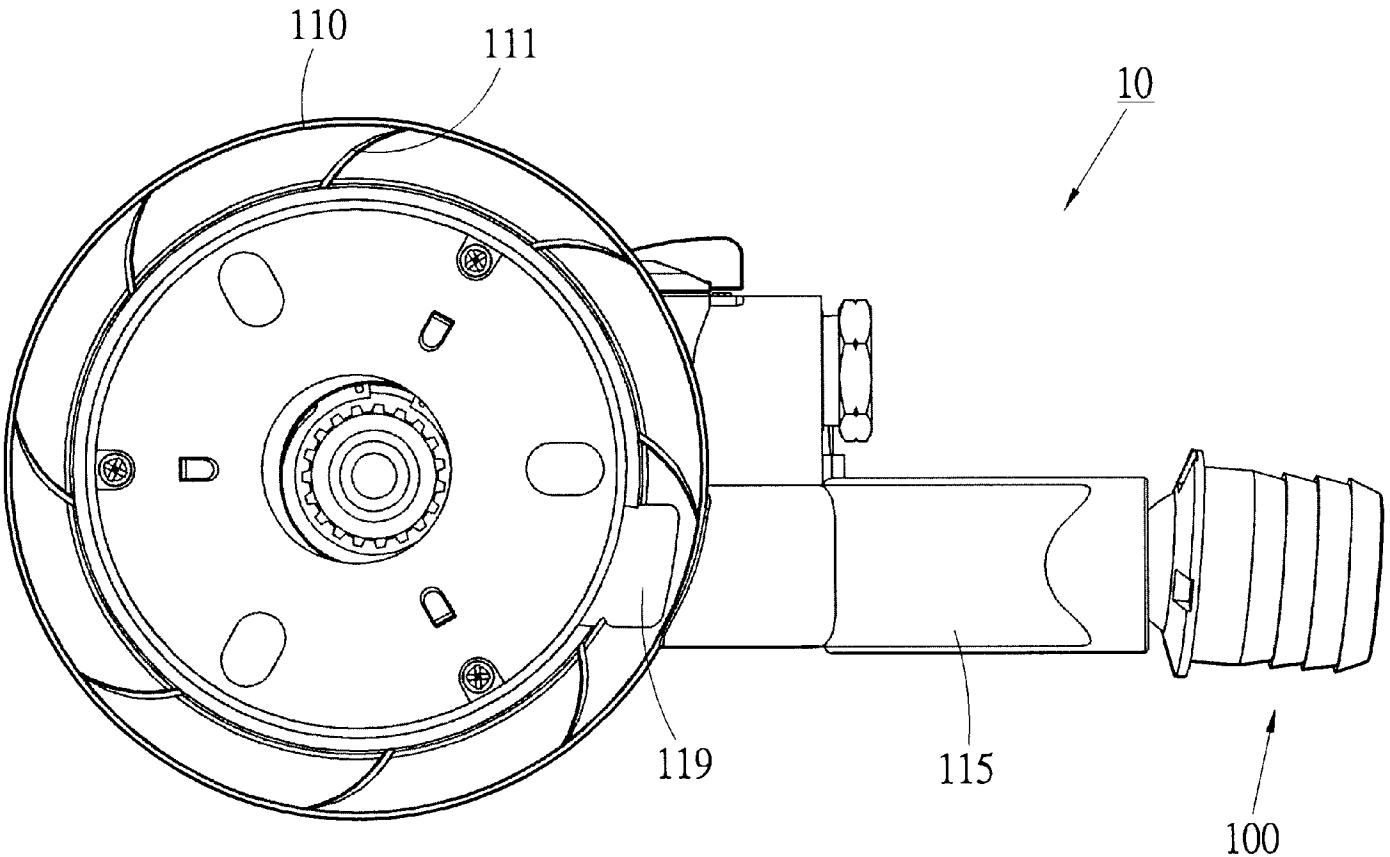
FIG. 11 is a bottom view according to FIG. 1.

In use, the exhausted gas is ejected from the nozzle 88 and flows rapidly in the tube body to form a fast speed and low pressure state at the opening 89 of the nozzle. In addition, referring to FIG. 11, several conducting ribs 111 are annularly disposed along the outer circumference of bottom face of the cover 110 at intervals. The conducting ribs 111 serve to conduct the airflow and activate the gas within the range covered by the cover. When the grinding disc rotates, the generated airflow is conducted by the conducting ribs to flow to the second portal 119 of the communicating tube 115. The powder generated in grinding is entrained by the airflow. Due to the injection effect of the nozzle 88, the pressure at the first portal 118 of the communicating tube 115 is less, while the pressure at the second portal 119 is greater. According to siphon principle, the fluid will flow from a place with higher pressure to a place with lower pressure. Accordingly, the airflow and the powder in the cover will be conducted by the communicating tube 115 to flow to the first portal 118 and discharge along with the waste gas exhausted from the nozzle. According to the above arrangement, the present invention has a self-sucking function and is able to suck the powder by means of pressure drop. Therefore, without any dust-collector, the grinder itself can collect the dust.

In addition, the ball valve connector 100 can be universally rotated. In operation, the exhaustion conduit and the ball valve connector can be deflected in accordance with the change of the operation angle. Therefore, the exhaustion conduit is prevented from being bent to obstruct the waste gas from being exhausted.

Moreover, the high pressure goes into the cylinder from the top end thereof so that it is easy to manufacture the cylinder room and install the cylinder.

It should be noted that the adjustment switch is not an inevitable, member. Furthermore, it is unnecessary for the high pressure air to first flow through the adjustment switch and then flow through the press switch. Alternatively, the high pressure air can first flow through the press switch and then flow through the adjustment switch.

The above embodiments are only used to illustrate the present invention not intended to limit the scope thereof.

What is claimed is:

1. A pneumatic tool with safety effect, comprising:

a main body, a cylinder room being formed in the main body for mounting a cylinder therein, a flow way being formed in the main body, one end of the flow way passing through the main body to the cylinder room and communicating with the cylinder, the other end of the flow way being positioned on a circumferential face of the main body for conducting high pressure air into the cylinder;

a press switch disposed in the main body and communicating with the flow way, the press switch being operable between an opened position and a closed position, whereby when the press switch is not pressed, the press switch is kept in the closed position to block the flow way;

a slide member disposed on the main body, the slide member being horizontally movable between an operation position and a non-operation position, a linking member being up and down movably connected with the slide member, whereby when the slide member is positioned in the non-operation position, a position difference exists between the linking member and the press switch, while when the slide member is positioned in the operation position, the linking member is moved to a position above the press switch and aligned with the press switch; and a trigger, one end of the trigger being pivotally connected with the main body, the trigger being up and down swingable within a certain angular range;

whereby when the slide member is positioned in the operation position, the trigger can be pressed to press down the linking member and switch the press switch to the opened position so as to free the flow way, while when the slide member is positioned in the non-operation position, the press switch cannot be switched by means of pressing the trigger.

2. The pneumatic tool as claimed in claim 1, wherein the slide member is formed with a through hole vertically passing through the slide member, the linking member being a touch rod undetachably fitted through the through hole, whereby when the linking member does not press the press switch, a top end of the linking member protrudes from top face of the slide member.

3. The pneumatic tool as claimed in claim 1, further comprising a resilient member disposed between the slide member and the main body, the resilient member serving to resiliently keep the slide member in the non-operation position in normal state.

4. The pneumatic tool as claimed in claim 1, wherein the main body is formed with a horizontal guide channel and the slide member is undetachably inlaid in the guide channel and slidable along the guide channel.

5. The pneumatic tool as claimed in claim 4, wherein the guide channel is formed on the circumferential face of the main body, the slide member having a U-shaped front half and a U-shaped rear half each having two arms on two sides, front ends of the arms being hooked with each other to assemble the two halves together, the two halves being inlaid in the guide channel.

6. The pneumatic tool as claimed in claim 1, wherein the main body is formed with a horizontal guide rail and the slide member is connected with the guide rail by insertion and movable along the guide rail.

7. The pneumatic tool as claimed in claim 1, wherein the main body has a main section and an extension section connected with rear side of the main section, a guide rail being horizontally formed on top face of the extension section, a rear end of the slide member being formed with a platform, bottom face of the platform being formed with an insertion groove in which the guide rail is inlaid.

8. The pneumatic tool as claimed in claim 1, wherein the top face of the main body is inward recessed to form a chamber, the press switch including a valve member having a valve section, the valve member being airtight and up and down movably fitted in the chamber and having an upper dead end, an annular shoulder section being formed on the circumference of the chamber, a resilient member being disposed between the chamber and the valve member to resiliently keep pushing the valve member upward to the upper dead end, the valve section tightly abutting against the shoulder section to block the flow way.

9. The pneumatic tool as claimed in claim 8, wherein the valve body further includes a rod section connected with upper side of the valve section, the press switch further including a barrel section formed with an axial through hole, the barrel section being tightly fitted in the chamber, the rod section being fitted through the through hole of the barrel section, whereby when the linking member switches the press switch, the linking member presses the rod section.

10. The pneumatic tool as claimed in claim 9, wherein the bottom end of the barrel section is spaced from the bottom face of the chamber by a certain distance to form the shoulder section.

11. The pneumatic tool as claimed in claim 2, wherein the main body has a main section and an extension section connected with rear side of the main section, the press switch being disposed in the extension section, the rear end of the slide member being formed with a platform positioned on the top face of the extension section, the through hole being formed on the platform.

12. The pneumatic tool as claimed in claim 1, wherein the main body is formed with a dent communicating with the flow way, the pneumatic tool further comprising an adjustment switch having a hollow cylindrical valve body and shift switch connected with one end of the valve body, a circumference of the valve body being formed with a circumferential slot, the width of the slot being tapered from one end to the other, the valve body of the adjustment switch being airtight rotatably mounted in the dent, the slot being aligned with a section of the flow way communicating with the dent, whereby after the air flows from the flow way into the dent, the air flows through the slot and the interior of the valve body out of the dent toward the cylinder, the shift switch being positioned on outer side of the dent for an operator to turn.

13. The pneumatic tool as claimed in claim 12, wherein the main body is formed with an internal chamber in which the press switch is disposed, a free end of the valve body of the adjustment switch being formed with a shaft hole, the flow way including a first pore section passing through the circumference of the main body to the dent, a second pore section communicating with the dent and the chamber and a third pore section communicating with the chamber and the cylinder room, the slot of the adjustment switch corresponding to the first pore section, the shaft hole corresponding to the second pore section.

14. The pneumatic tool as claimed in claim 1, further comprising a soft protective sheath fitted on top end of the main body to enclose the slide member.

15.The pneumatic tool as claimed in claim 1, further comprising:

an exhaustion port formed on a predetermined section of the main body, one end of the exhaustion port communicating with the cylinder room, the other end of the exhaustion port communicating with outer side, whereby the air going into the cylinder can be exhausted from the exhaustion port;

a nozzle disposed in the main body and communicating with the exhaustion port, the opening of the nozzle being directed to outer side;

a tube body, one end of the tube body being fixed on the circumference of the main body, the nozzle being positioned in the tube body, a free end of the tube body outward extending by a certain length longer than the opening of the nozzle;

a cover disposed at bottom end of the main body; and a communicating tube connected with the cover and the tube body to communicate the cover with the tube body, an adjoining section between the communicating tube and the tube body is formed with a portal right positioned in the position of the opening of the nozzle.

16. The pneumatic tool as claimed in claim 15, wherein a predetermined number of conducting ribs are annularly disposed along the outer circumference of bottom face of the cover at intervals.

17. The pneumatic tool as claimed in claim 15, further comprising a ball valve connector having a ball valve body and a connector, the ball valve body being formed with an internal axial through hole, one end of the ball valve body being connected with the free end of the tube body, the other end thereof being ball valve section protruding out of the tube body, a front end of the connector being formed with a spherical socket in which the ball valve section is fitted.

18. The pneumatic tool as claimed in claim 1, wherein the top end of the cylinder is formed with an intake communicating with the flow way.

* * * * *